US008161653B2

(12) United States Patent
Nenadic

(10) Patent No.: US 8,161,653 B2
(45) Date of Patent: Apr. 24, 2012

(54) FOLDING TOOL HAVING A ROTATABLE LOCKING MECHANISM

(75) Inventor: John P. Nenadic, Camas, WA (US)

(73) Assignee: Leatherman Tool Group, Inc., Portland, OR (US)

( * ) Notice: Subject to any disclaimer, the term of this patent is extended or adjusted under 35 U.S.C. 154(b) by 417 days.

(21) Appl. No.: 11/938,580

(22) Filed: Nov. 12, 2007

(65) Prior Publication Data

US 2009/0119926 A1 May 14, 2009

(51) Int. Cl.
*B26B 1/02* (2006.01)

(52) U.S. Cl. ..... 30/161; 30/155; 30/160

(58) Field of Classification Search ..... 30/153–155, 30/158–161, 337, 338, 340, 342
See application file for complete search history.

(56) References Cited

U.S. PATENT DOCUMENTS

| | | | |
|---|---|---|---|
| 23,975 | A | 5/1859 | Belcher |
| 57,902 | A | 9/1866 | Hibbard |
| 208,654 | A | 10/1878 | Waldman et al. |
| 226,910 | A | 4/1880 | Friebertshauser |
| 234,731 | A | 11/1880 | Slayton |
| 338,251 | A | 3/1886 | Crandall et al. |
| 382,967 | A | 5/1888 | Fullerton |
| 404,870 | A | 6/1889 | Schenck |
| D137,408 | S | 6/1890 | Herrick |
| 530,792 | A | 12/1894 | Nordlow |
| 551,052 | A | 12/1895 | Shonnand et al. |
| 552,928 | A | 1/1896 | Russell |
| 557,760 | A | 4/1896 | Brauer |
| 577,593 | A | 2/1897 | Bronson et al. |
| 600,442 | A | 3/1898 | Nell |
| 616,689 | A | 12/1898 | Ruettgers |
| 749,230 | A | 1/1904 | Severance |
| 777,358 | A | 12/1904 | Weck |
| 825,976 | A | 7/1906 | Neiglick |
| 845,792 | A | 3/1907 | Jenkins |
| 927,532 | A | 7/1909 | Heissenberger |
| 969,909 | A | 9/1910 | Schrade et al. |
| 1,012,555 | A | 12/1911 | Irick |
| 1,057,525 | A | 4/1913 | Bruecker |
| 1,189,005 | A | 6/1916 | Seely |
| 1,232,886 | A | 7/1917 | Boston |
| 1,315,503 | A | 9/1919 | Hughes |
| 1,315,901 | A | 9/1919 | Ballinger |
| 1,319,532 | A | 10/1919 | Rasmussen |

(Continued)

FOREIGN PATENT DOCUMENTS

| | | |
|---|---|---|
| DE | 29469 | 6/1884 |

(Continued)

*Primary Examiner* — Phong Nguyen
(74) *Attorney, Agent, or Firm* — Alston & Bird LLP

(57) ABSTRACT

A folding tool and an associated locking mechanism are provided in order to securely and reliably retain an implement, such as a knife blade, in an open position. The folding tool may include a handle, an implement pivotally connected to the handle and a lock. The lock, in turn, may include an engagement member for movement with the blade and a pivotable member, such as a cam member, configured to pivot relative to the handle between first and second positions. As a result of controlled interaction between the engagement member and the pivotable member, such as a result of camming action provided by the cam member, the rotatable implement can be secured in the open position. If desired, the rotatable implement may be released and folded into the closed position.

5 Claims, 8 Drawing Sheets

U.S. PATENT DOCUMENTS

| | | | |
|---|---|---|---|
| 1,357,398 | A | 11/1920 | Haywood |
| 1,412,373 | A | 4/1922 | Shields |
| 1,417,872 | A | 5/1922 | Wall |
| 1,440,793 | A | 1/1923 | Rasmussen |
| 1,454,665 | A | 5/1923 | Bobek |
| 1,496,188 | A | 6/1924 | Wall |
| 1,515,688 | A | 11/1924 | Love |
| 1,584,165 | A | 5/1926 | Brown |
| 1,603,914 | A | 10/1926 | Hermann |
| 1,614,949 | A | 1/1927 | Finley |
| 1,701,027 | A | 2/1929 | Brown |
| 1,738,496 | A | 12/1929 | Laux |
| 1,743,022 | A | 1/1930 | Carman |
| 1,810,031 | A | 6/1931 | Schrade |
| 1,828,121 | A | 10/1931 | Adam et al. |
| 1,864,011 | A | 6/1932 | Brown |
| 1,898,422 | A | 2/1933 | Champlin |
| 2,250,290 | A | 7/1941 | Berg |
| 2,263,415 | A | 11/1941 | Berg et al. |
| 2,284,168 | A | 5/1942 | Rickenbacher |
| 2,286,524 | A | 6/1942 | Wilbur |
| 2,327,090 | A | 8/1943 | Berg |
| 2,343,175 | A | 2/1944 | Evinger |
| 2,407,897 | A | 9/1946 | Newman |
| 2,455,765 | A | 12/1948 | Harvey |
| 2,736,959 | A | 3/1956 | Simon et al. |
| 3,079,784 | A | 3/1963 | Parlowski |
| 3,404,456 | A | 10/1968 | Chilko |
| 3,868,774 | A | 3/1975 | Miori |
| 3,875,600 | A | 4/1975 | Reveaux |
| 3,942,249 | A | 3/1976 | Poehlmann |
| 4,040,181 | A | 8/1977 | Johnson |
| 4,083,110 | A | 4/1978 | Goldin et al. |
| 4,124,939 | A | 11/1978 | Onoue |
| 4,133,106 | A | 1/1979 | Addis |
| 4,148,140 | A | 4/1979 | Lile |
| 4,170,061 | A | 10/1979 | Henry |
| 4,173,068 | A | 11/1979 | Cargill |
| 4,211,003 | A | 7/1980 | Collins |
| 4,218,819 | A | 8/1980 | Phelps |
| 4,240,201 | A | 12/1980 | Sawby et al. |
| 4,268,960 | A | 5/1981 | Reinschreiber |
| 4,272,887 | A | 6/1981 | Poehlmann |
| 4,274,200 | A | 6/1981 | Coder |
| 4,322,885 | A | 4/1982 | Osada |
| 4,347,665 | A | 9/1982 | Glesser |
| 4,356,631 | A | 11/1982 | Guth |
| 4,389,775 | A | 6/1983 | Collins |
| 4,404,748 | A | 9/1983 | Wiethoff |
| 4,426,779 | A | 1/1984 | Morgan |
| 4,439,922 | A | 4/1984 | Sassano |
| 4,442,559 | A | 4/1984 | Collins |
| 4,442,600 | A | 4/1984 | Felix-Dalichow |
| 4,451,982 | A | 6/1984 | Collins |
| 4,466,561 | A | 8/1984 | Slaughter |
| 4,481,712 | A | 11/1984 | Phelps |
| 4,494,309 | A | 1/1985 | Gray |
| 4,494,310 | A | 1/1985 | Slaughter |
| 4,501,068 | A | 2/1985 | Palson |
| 4,502,221 | A | 3/1985 | Pittman |
| 4,524,518 | A | 6/1985 | West |
| 4,525,928 | A | 7/1985 | Foster |
| 4,529,111 | A | 7/1985 | Hayakawa |
| D280,178 | S | 8/1985 | Lang |
| 4,536,959 | A | 8/1985 | Ross |
| 4,541,175 | A | 9/1985 | Boyd et al. |
| 4,541,556 | A | 9/1985 | Collins et al. |
| 4,561,577 | A | 12/1985 | Moore |
| 4,563,813 | A | 1/1986 | Fortenberry |
| 4,570,341 | A | 2/1986 | Konneker |
| 4,600,133 | A | 7/1986 | Maihos |
| 4,604,803 | A | 8/1986 | Sawby |
| 4,606,123 | A | 8/1986 | Wrench |
| 4,607,432 | A | 8/1986 | Montgomery |
| 4,612,706 | A | 9/1986 | Yunes |
| 4,651,419 | A | 3/1987 | Reed, Jr. |
| 4,670,984 | A | 6/1987 | Rickard |
| 4,719,700 | A | 1/1988 | Taylor, Jr. |
| 4,741,106 | A | 5/1988 | Yamagishi |
| 4,750,267 | A | 6/1988 | Boyd |
| 4,776,094 | A | 10/1988 | Glesser |
| 4,802,279 | A | 2/1989 | Rowe |
| 4,805,250 | A | 2/1989 | Dugas |
| 4,805,303 | A | 2/1989 | Gibbs |
| 4,805,819 | A | 2/1989 | Collins |
| 4,811,486 | A | 3/1989 | Cunningham |
| 4,837,932 | A | 6/1989 | Elsener |
| 4,848,000 | A | 7/1989 | O'Dell |
| 4,869,011 | A | 9/1989 | Whiting et al. |
| 4,882,841 | A | 11/1989 | Margolis |
| 4,893,409 | A | 1/1990 | Poehlmann |
| 4,896,424 | A | 1/1990 | Walker |
| 4,901,439 | A | 2/1990 | Boyd, Jr. |
| 4,909,424 | A | 3/1990 | Reynolds |
| 4,918,820 | A | 4/1990 | Korb et al. |
| 4,947,552 | A | 8/1990 | Barnes |
| D310,621 | S | 9/1990 | Thompson |
| 4,974,323 | A | 12/1990 | Cassady |
| 4,979,301 | A | 12/1990 | Walker |
| 5,044,079 | A | 9/1991 | Gibbs |
| 5,060,379 | A | 10/1991 | Neely |
| 5,092,045 | A | 3/1992 | Boyd, Jr. et al. |
| 5,095,624 | A | 3/1992 | Ennis |
| 5,111,581 | A | 5/1992 | Collins |
| 5,123,167 | A | 6/1992 | Kelley |
| 5,131,149 | A | 7/1992 | Thompson et al. |
| D333,251 | S | 2/1993 | Glesser |
| 5,210,895 | A | 5/1993 | Hull et al. |
| D336,602 | S | 6/1993 | Thompson et al. |
| 5,217,150 | A | 6/1993 | Chen |
| 5,217,151 | A | 6/1993 | Parsons |
| 5,245,721 | A | 9/1993 | Lowe et al. |
| 5,251,353 | A | 10/1993 | Lin |
| 5,280,659 | A | 1/1994 | Park |
| D345,289 | S | 3/1994 | Sakai |
| 5,293,690 | A | 3/1994 | Cassady |
| D348,599 | S | 7/1994 | Sakai |
| 5,325,588 | A | 7/1994 | Rogers |
| 5,331,741 | A | 7/1994 | Taylor |
| 5,349,753 | A | 9/1994 | Gaffney |
| 5,361,497 | A | 11/1994 | Crawford |
| 5,400,509 | A | 3/1995 | Collins |
| 5,425,175 | A | 6/1995 | Rogers |
| 5,437,101 | A | 8/1995 | Collins |
| 5,450,670 | A | 9/1995 | Sakai |
| 5,461,786 | A | 10/1995 | Miller |
| D365,266 | S | 12/1995 | Hasegawa |
| D366,408 | S | 1/1996 | Sessions et al. |
| 5,493,781 | A | 2/1996 | Saito |
| 5,495,673 | A | 3/1996 | Gardiner et al. |
| 5,495,674 | A | 3/1996 | Taylor |
| 5,502,895 | A | 4/1996 | Lemaire |
| 5,511,310 | A | 4/1996 | Sessions et al. |
| 5,511,311 | A | 4/1996 | Collins |
| 5,515,610 | A | 5/1996 | Levin et al. |
| 5,537,750 | A | 7/1996 | Seber et al. |
| 5,546,662 | A | 8/1996 | Seber et al. |
| D373,296 | S | 9/1996 | Thompson |
| D373,716 | S | 9/1996 | Keys et al. |
| 5,553,340 | A | 9/1996 | Brown, Jr. |
| 5,581,834 | A | 12/1996 | Collins |
| 5,581,895 | A | 12/1996 | Jeffcoat |
| 5,596,808 | A | 1/1997 | Lake et al. |
| D378,489 | S | 3/1997 | Poehlmann |
| 5,615,484 | A | 4/1997 | Pittman |
| 5,628,117 | A | 5/1997 | Glesser |
| 5,647,129 | A | 7/1997 | Stamper |
| D385,173 | S | 10/1997 | McWillis |
| 5,685,079 | A | 11/1997 | Brothers et al. |
| 5,689,885 | A | 11/1997 | Walston |
| 5,692,304 | A | 12/1997 | Campbell |
| 5,699,615 | A | 12/1997 | Chen |
| D392,538 | S | 3/1998 | Buck et al. |
| D392,539 | S | 3/1998 | Balolia |
| 5,737,841 | A | 4/1998 | McHenry et al. |
| 5,755,035 | A | 5/1998 | Weatherly |
| 5,765,247 | A | 6/1998 | Seber et al. |

| | | | |
|---|---|---|---|
| 5,781,950 | A | 7/1998 | Swinden et al. |
| 5,781,998 | A | 7/1998 | Stamper |
| 5,802,722 | A | 9/1998 | Maxey et al. |
| 5,809,600 | A | 9/1998 | Cachot |
| D399,113 | S | 10/1998 | Balolia |
| 5,815,927 | A | 10/1998 | Collins |
| 5,819,414 | A | 10/1998 | Mairfone |
| 5,822,866 | A | 10/1998 | Pardue |
| 5,822,867 | A | 10/1998 | Sakai |
| 5,826,340 | A | 10/1998 | Hull |
| 5,839,194 | A | 11/1998 | Bezold |
| 5,845,404 | A | 12/1998 | Jeffcoat |
| D407,003 | S | 3/1999 | Macowski et al. |
| 5,875,552 | A | 3/1999 | Chen |
| 5,878,500 | A | 3/1999 | Emerson |
| 5,887,347 | A | 3/1999 | Gibbs |
| 5,896,665 | A | 4/1999 | Harris |
| 5,915,792 | A | 6/1999 | Sakurai |
| D412,275 | S | 7/1999 | Collins |
| 5,964,035 | A | 10/1999 | Poehlmann |
| 5,964,036 | A | 10/1999 | Centofante |
| 5,966,816 | A | 10/1999 | Roberson |
| 5,979,059 | A | 11/1999 | Leatherman et al. |
| D422,479 | S | 4/2000 | Pardue |
| 6,079,106 | A | 6/2000 | Vallotton |
| 6,088,860 | A | 7/2000 | Poehlmann et al. |
| 6,101,724 | A | 8/2000 | Halligan |
| 6,105,255 | A | 8/2000 | Cheng |
| 6,112,352 | A | 9/2000 | Legg |
| 6,122,829 | A | 9/2000 | McHenry et al. |
| 6,125,543 | A | 10/2000 | Jhones |
| 6,145,202 | A | 11/2000 | Onion |
| 6,145,851 | A | 11/2000 | Heber |
| D434,631 | S | 12/2000 | Lum |
| D435,421 | S | 12/2000 | Strider et al. |
| 6,154,965 | A | 12/2000 | Sakai |
| 6,158,127 | A | 12/2000 | Taylor |
| D435,776 | S | 1/2001 | Veltz et al. |
| 6,170,104 | B1 | 1/2001 | Seber et al. |
| D438,085 | S | 2/2001 | Onion |
| 6,212,779 | B1 | 4/2001 | Mitchell |
| 6,223,372 | B1 | 5/2001 | Barber |
| 6,233,769 | B1 | 5/2001 | Seber et al. |
| 6,256,887 | B1 | 7/2001 | Osborne |
| 6,256,888 | B1 | 7/2001 | Shuen |
| 6,276,063 | B1 | 8/2001 | Chen |
| 6,282,997 | B1 | 9/2001 | Frazer |
| 6,286,397 | B1 | 9/2001 | Taggart et al. |
| 6,289,592 | B1 | 9/2001 | Emerson |
| 6,308,420 | B1 | 10/2001 | Moser |
| 6,338,431 | B1 | 1/2002 | Onion |
| D454,769 | S | 3/2002 | Gardner et al. |
| 6,360,443 | B1 | 3/2002 | Remus |
| 6,363,615 | B1 | 4/2002 | Moser |
| 6,371,841 | B1 | 4/2002 | Ray |
| 6,378,214 | B1 | 4/2002 | Onion |
| 6,389,625 | B1 | 5/2002 | Rivera |
| 6,397,476 | B1 | 6/2002 | Onion |
| 6,397,477 | B1 | 6/2002 | Collins |
| D461,386 | S | 8/2002 | Ray |
| 6,427,334 | B2 | 8/2002 | Onion |
| 6,427,335 | B1 | 8/2002 | Ralph |
| 6,430,816 | B2 | 8/2002 | Neveux |
| 6,434,831 | B2 | 8/2002 | Chen |
| 6,438,848 | B1 | 8/2002 | McHenry et al. |
| 6,438,849 | B1 | 8/2002 | Wonderley |
| D462,581 | S | 9/2002 | Parlowski |
| D462,582 | S | 9/2002 | Parlowski |
| 6,442,843 | B1 | 9/2002 | Jue et al. |
| D464,246 | S | 10/2002 | Sloan |
| 6,490,797 | B1 | 12/2002 | Lake et al. |
| 6,553,671 | B2 | 4/2003 | Blanchard |
| D474,095 | S | 5/2003 | Luquire |
| 6,560,873 | B1 | 5/2003 | Ortner et al. |
| 6,574,868 | B1 | 6/2003 | Overholt |
| 6,574,869 | B1 | 6/2003 | McHenry et al. |
| 6,591,504 | B2 | 7/2003 | Onion |
| 6,594,906 | B1 | 7/2003 | Sakai et al. |
| 6,618,946 | B2 | 9/2003 | Seraphin |
| 6,618,947 | B1 | 9/2003 | Gardiner et al. |
| D480,492 | S | 10/2003 | Wu |
| 6,643,935 | B1 | 11/2003 | Lowe, Sr. et al. |
| 6,651,344 | B2 | 11/2003 | Cheng |
| D484,770 | S | 1/2004 | Green |
| 6,675,419 | B2 | 1/2004 | Rivera |
| 6,675,484 | B2 | 1/2004 | McHenry et al. |
| 6,684,510 | B1 | 2/2004 | Collins |
| 6,711,820 | B2 | 3/2004 | Chen |
| D489,956 | S | 5/2004 | Rae |
| 6,732,436 | B2 | 5/2004 | Moizis |
| 6,773,210 | B2 | 8/2004 | Erickson |
| D498,985 | S | 11/2004 | Kerr et al. |
| 6,810,588 | B1 | 11/2004 | Cheng |
| 6,918,184 | B2 | 7/2005 | Glesser |
| 6,959,494 | B2 | 11/2005 | Taylor |
| 7,000,323 | B1 | 2/2006 | Hatcher et al. |
| 7,059,053 | B2 | 6/2006 | Sakai |
| 7,124,509 | B1 | 10/2006 | Hawk |
| 7,124,510 | B2 | 10/2006 | Frazer |
| 7,296,355 | B2 | 11/2007 | Onion |
| 7,305,768 | B2 | 12/2007 | Hinderer |
| D564,326 | S | 3/2008 | Tsuda et al. |
| 7,395,599 | B2 | 7/2008 | Onion |
| 7,469,476 | B2 | 12/2008 | Demko |
| 7,533,465 | B1 | 5/2009 | Frazer |
| 7,562,454 | B2 | 7/2009 | Steigerwalt et al. |
| 2001/0016987 | A1 | 8/2001 | Chen |
| 2002/0000042 | A1 | 1/2002 | Glesser et al. |
| 2002/0029426 | A1 | 3/2002 | Seber et al. |
| 2002/0095792 | A1 | 7/2002 | Jue et al. |
| 2002/0157260 | A1 | 10/2002 | Cheng |
| 2003/0070299 | A1 | 4/2003 | Frazer |
| 2003/0089750 | A1 | 5/2003 | Martinez |
| 2004/0020057 | A1 | 2/2004 | Hughes |
| 2004/0020058 | A1 | 2/2004 | Vallotton |
| 2004/0064953 | A1 | 4/2004 | Cheng |
| 2004/0078981 | A1 | 4/2004 | Cheng |
| 2004/0158991 | A1 | 8/2004 | Freeman |
| 2005/0044717 | A1* | 3/2005 | Nishihara ..... 30/161 |
| 2005/0072005 | A1 | 4/2005 | Taylor |
| 2005/0097754 | A1 | 5/2005 | Onion |
| 2005/0172497 | A1 | 8/2005 | Linn et al. |
| 2005/0223563 | A1 | 10/2005 | VanHoy et al. |
| 2005/0274234 | A1 | 12/2005 | Lee |
| 2006/0016080 | A1 | 1/2006 | Frazer |
| 2006/0168819 | A1 | 8/2006 | Perreault |
| 2006/0174490 | A1 | 8/2006 | Galyean et al. |
| 2006/0260138 | A1 | 11/2006 | VanHoy |
| 2007/0022849 | A1 | 2/2007 | Poehlmann |
| 2007/0101579 | A1 | 5/2007 | Kain |
| 2007/0130777 | A1 | 6/2007 | Ping |

FOREIGN PATENT DOCUMENTS

| | | |
|---|---|---|
| DE | 1104386 | 4/1961 |
| EP | 0100377 A1 | 2/1984 |
| EP | 0230000 | 7/1987 |
| EP | 0714736 A1 | 6/1996 |
| FR | 493741 | 8/1919 |
| FR | 1069862 | 7/1954 |
| FR | 1171740 | 1/1959 |
| FR | 1248117 | 3/1961 |
| FR | 2705606 | 12/1994 |
| GB | 2190321 A | 11/1987 |
| JP | 3227601 | 10/1991 |
| JP | 4-30979 | 3/1992 |

* cited by examiner

FOLDING TOOL HAVING A ROTATABLE LOCKING MECHANISM

FIELD OF THE INVENTION

Embodiments of the present invention relate generally to hand tools and, more particularly, to a hand tool having a folding implement as well as associated locking mechanisms.

BACKGROUND OF THE INVENTION

A variety of hand tools have been developed including hand tools having folding implements. For example, hand held knives include knives having folding blade designs. By including folding implements, such as a folding pocket knife, a hand tool can include one or more implements in a relatively compact package. Moreover, the capability of folding an implement at least partially into the handle may increase the safety of these hand tools since the implements need not extend from the handle in instances in which the hand tool is not in use. For example, a knife having a folding blade design can be disposed in a folded configuration when not in use such that the cutting edge of the knife blade is safely disposed within the handle and will not be a safety hazard.

Although folding tools provide a relatively compact and safe form for the hand tool when not in use, folding hand tools generally require a locking mechanism to ensure that the implement that has been deployed is locked into position and will not fold up during use. Various locking mechanisms have been developed including, for example, liner locks and lockbacks. For example, a liner lock generally includes a liner plate disposed within the handle of the hand tool. The liner plate includes an elongate finger-like portion that is bent to extend at a slight angle toward the blade. As such, the distal end of the finger-like portion bears against a locking face of the blade when the blade is in an open position as a result of the elastic force provided by the finger-like portion. The liner lock therefore prevents the blade from being moved from the open position to a closed position without manually disengaging the liner lock. By way of another example, a lockback includes a spring disposed within the handle that includes a lug for engaging a corresponding notch or recess defined by the blade in order to secure the knife blade in an open position. The lockback must also be manually disengaged to permit the blade to fold into the closed position.

While liner locks and lockbacks as well as other conventional locking mechanisms are useful to secure a folding implement in an open position, it would be desirable to further improve the locking mechanisms employed by hand tools.

BRIEF SUMMARY OF THE INVENTION

A folding tool and an associated locking mechanism are provided according to embodiments of the present invention in order to securely and reliably retain an implement in an open position. In accordance with one aspect of the present invention, a folding tool is provided that includes a handle, an implement pivotally connected to the handle and a lock. The lock, in turn, includes an engagement member for movement with the blade and a pivotable member configured to pivot relative to the handle between first and second positions.

In one embodiment, the implement is configured to move between a closed position and an open position. Since the engagement member is configured for movement with the blade, the engagement member of this embodiment is also configured to engage the pivotable member upon movement of the implement from the closed position to the open position in order to move the pivotable member from the first position to the second position. The pivotable member is also configured to return to the first position once the implement is in the open position in order to lock the implement in the open position.

The handle may define a track within which the engagement member is disposed. As such, the engagement member of this embodiment is configured for movement with the blade through the track. In accordance with this embodiment, the pivotable member is also configured to pivot relative to the handle between the first position in which the pivotable member is at least partially disposed within the track and the second position in which the pivotable member is displaced from the track.

In one embodiment, the pivotable member is configured to pivot about a pivot point. Additionally, the pivotable member can be embodied by a cam member which, in turn, can include a curved surface spaced from the pivot point by a distance that increases from a first edge of the cam member to a portion of the cam member spaced from the first edge of the cam member. In accordance with this embodiment, the engagement member may be configured to initially contact the first edge of the cam member upon movement of the implement from the closed position toward the open position. Additionally, the engagement member may be configured to contact the curved surface of the cam member once the implement is in the open position. As a result of the configuration of the cam member, the cam member can urge the implement fully into the open position as the cam member returns to the first position as a result of the interaction created by the engagement member moving over the curved surface of the cam member.

In the embodiment in which the handle defines the track in which the engagement member rides, the handle may define the track such that opposite ends of the track extend beyond the pivotable member. As such, movement of the engagement member with the implement between the open and closed positions causes the pivotable member to be displaced from the track into the second position while the implement is in an intermediate position between the open and closed positions, while permitting the pivotable member to return to the first position while the blade is in both the open and closed positions.

The folding tool can also include a spring for biasing the pivotable member toward the first position. The folding tool of one embodiment can also include an actuation member operably connected to the pivotable member and configured to permit manual movement of the pivotable member relative to the handle, such as to unlock the implement and to permit the implement to be moved from the open position to the closed position. The folding tool can also include an engagement spring for engaging the engagement member once the implement is in the closed position in order to bias the implement to remain in the closed position.

According to another aspect of the present invention, a handle for a folding tool is provided that includes a handle portion defining a track, a pivotable member configured to pivot relative to the handle portion between a first position in which the pivotable member is at least partially disposed within the track and a second position in which the pivotable member is displaced from the track, and a spring for biasing the pivotable member toward the first position. The pivotable member of this embodiment may also be configured to pivot about a pivot point and may be embodied as a cam member that includes a curved surface spaced from the pivot point by a distance that increases from the first edge of the cam member to a portion of the cam member spaced from the first edge of the cam member. As noted above, the opposite ends of the track may extend beyond the pivotable member. Additionally, the handle can include an actuation member operably connected to the pivotable member and configured to permit manual movement of the pivotable member relative to the handle portion. The handle can also include an engagement spring for biasing a blade of the folding tool to remain in a closed position.

Accordingly, the folding tool and associated handle of embodiments of the present invention permit an implement to be moved between closed and open positions, while securely locking the implement in the open position. In this regard, the folding tool and associated handle include a pivotable member, such as a cam member having a curved surface for urging the implement fully into the open position, thereby providing a secure and reliable locking mechanism.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 1:
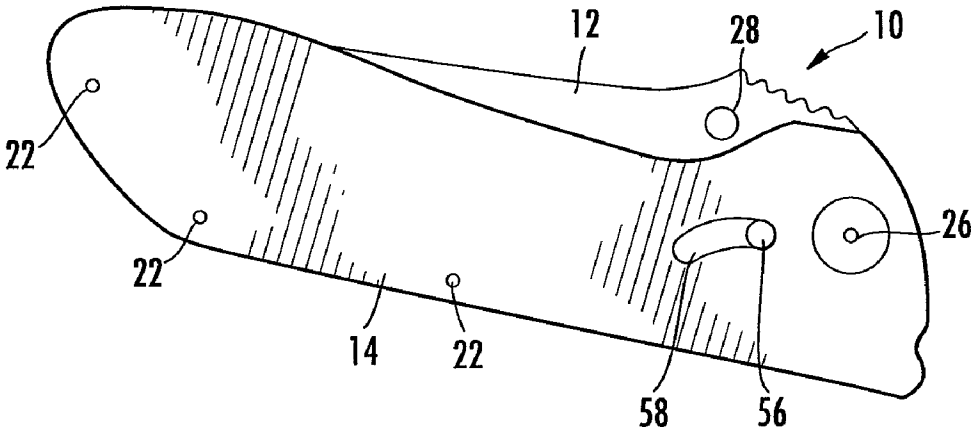
FIG. 1 is a perspective view of a hand tool in a closed position according to one embodiment of the present invention.
Figure 2:
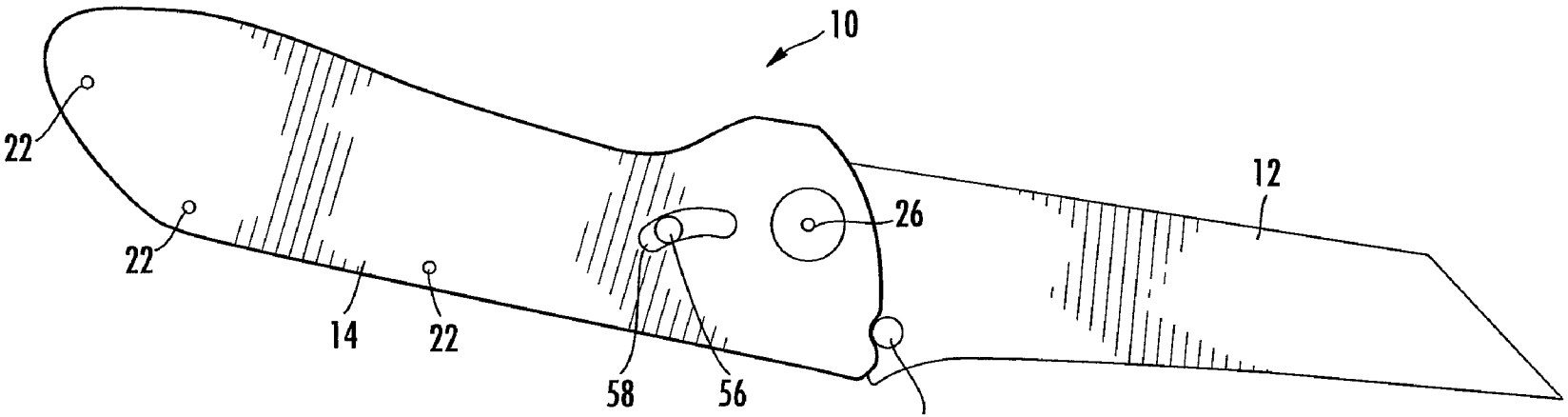
FIG. 2 is a perspective view of the hand tool of FIG. 1 in an open position according to one embodiment of the present invention.
Figure 5A:
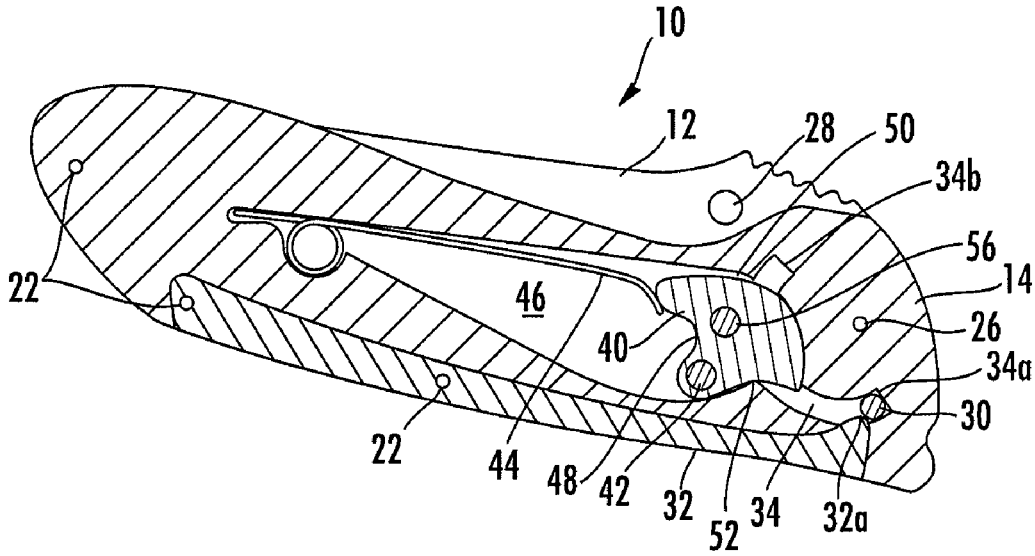
Figure 5B:
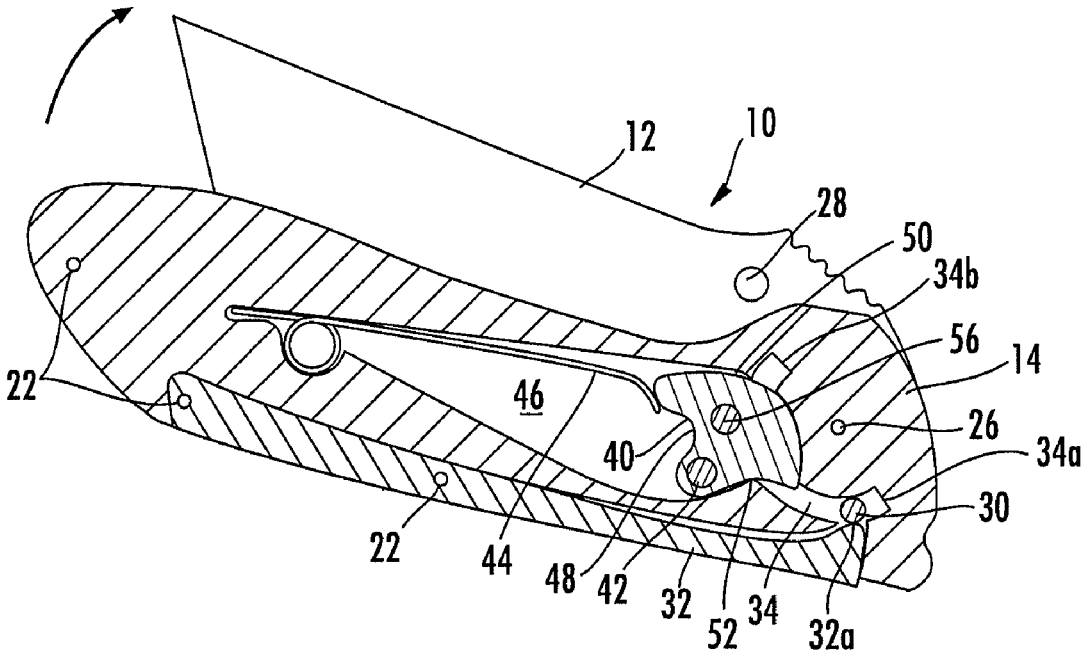
Figure 5C:
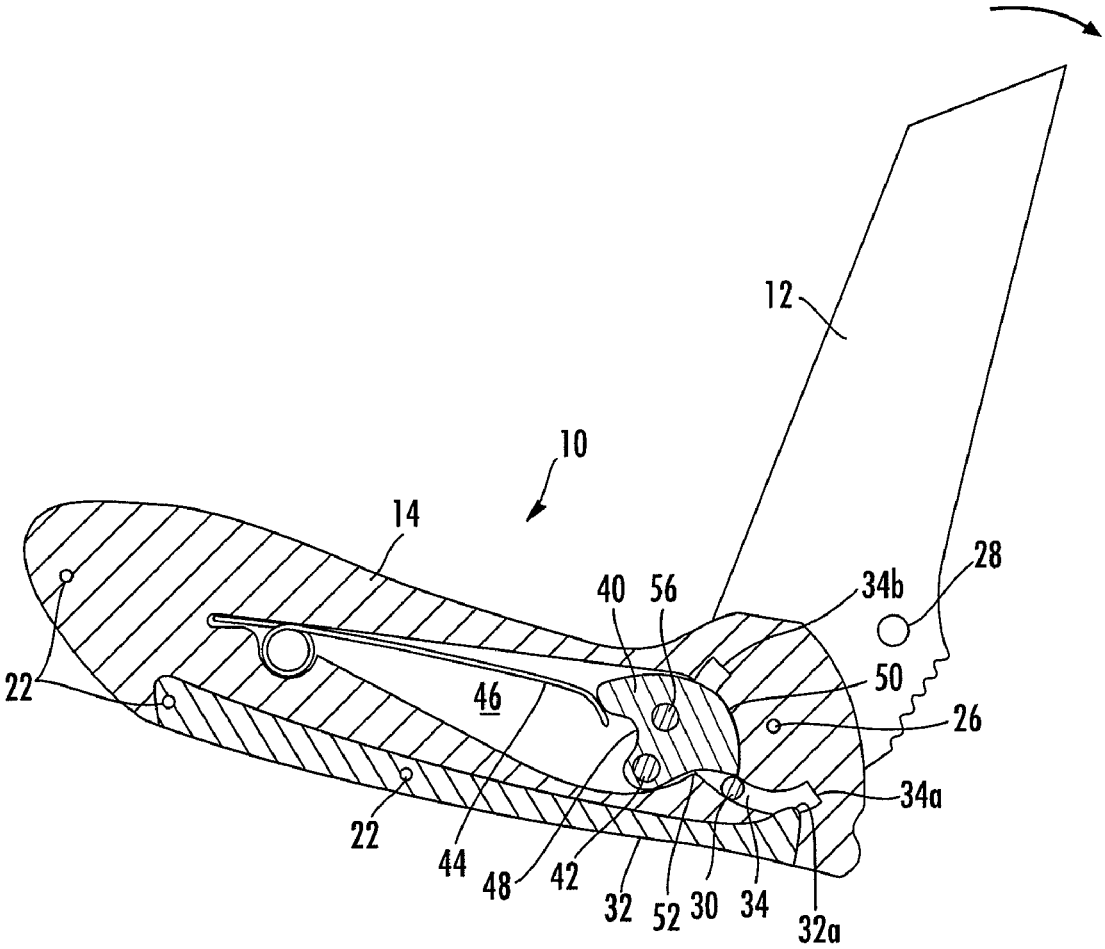
Figure 5D:
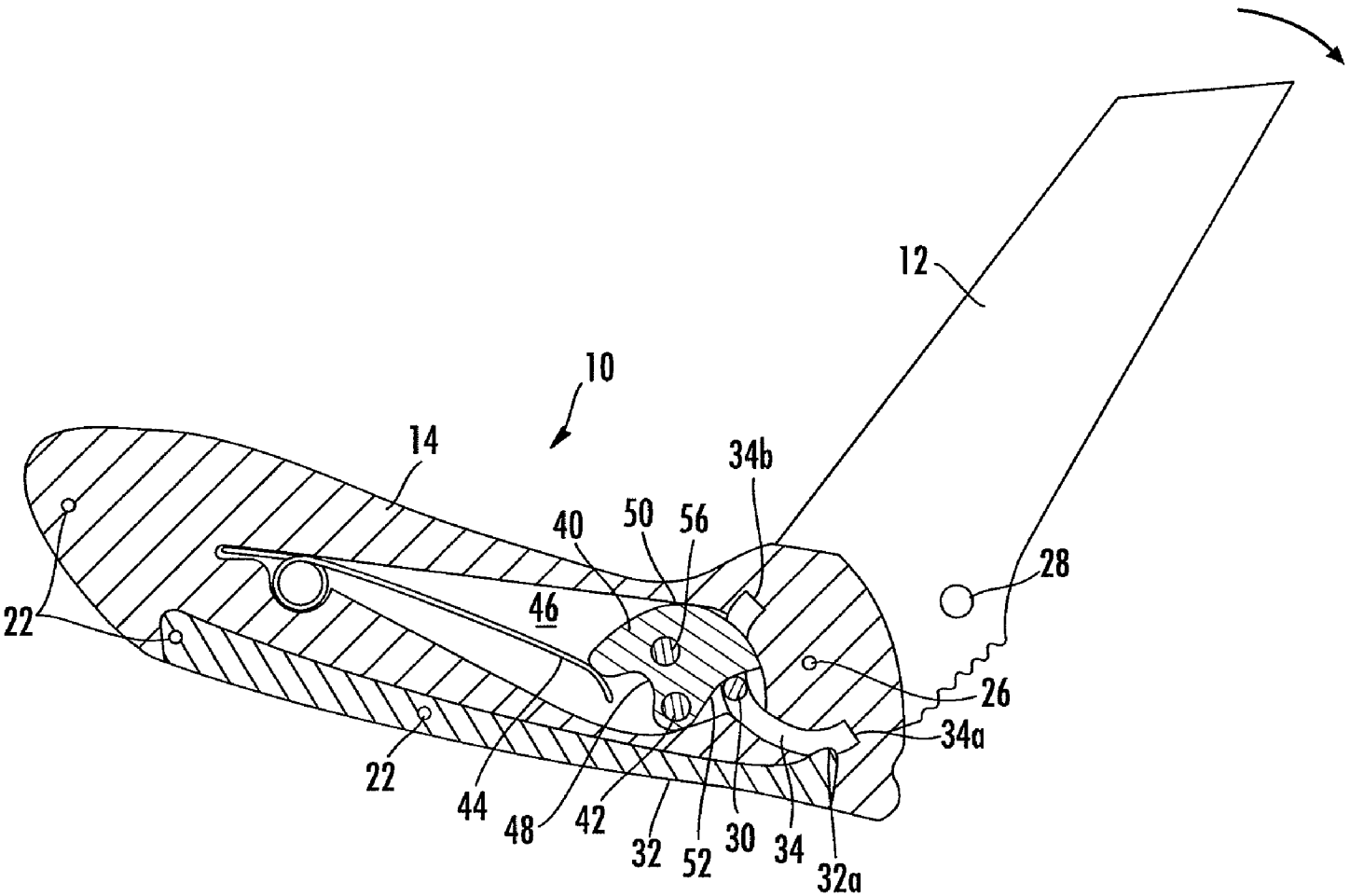
Figure 5E:
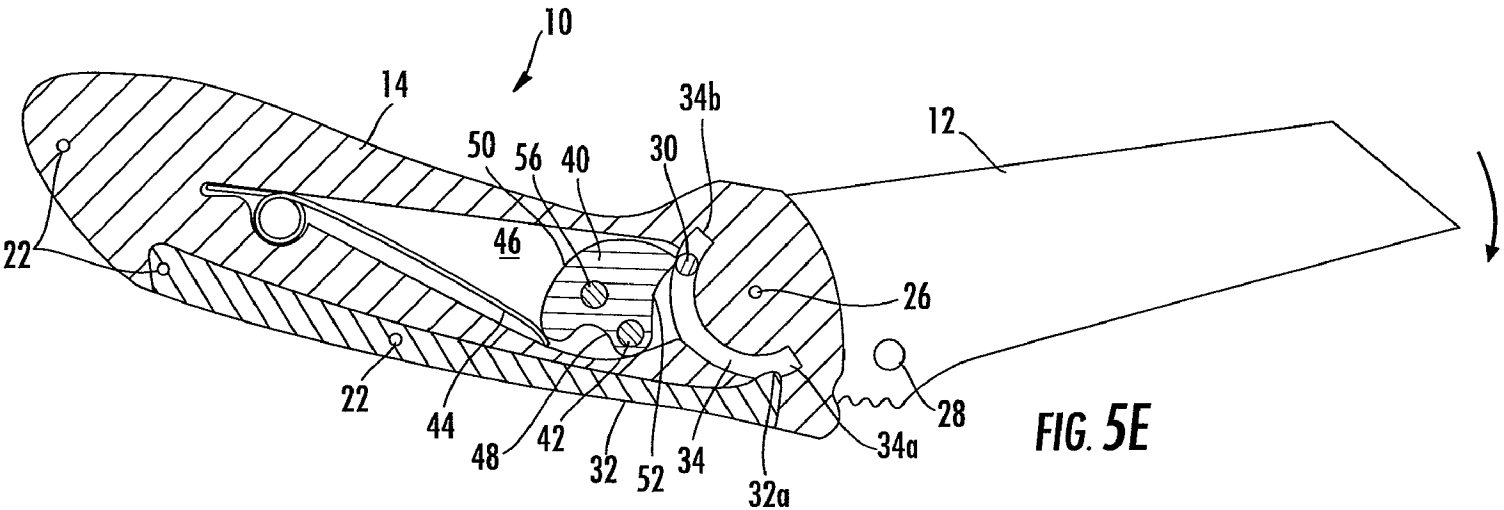
Figure 5F:
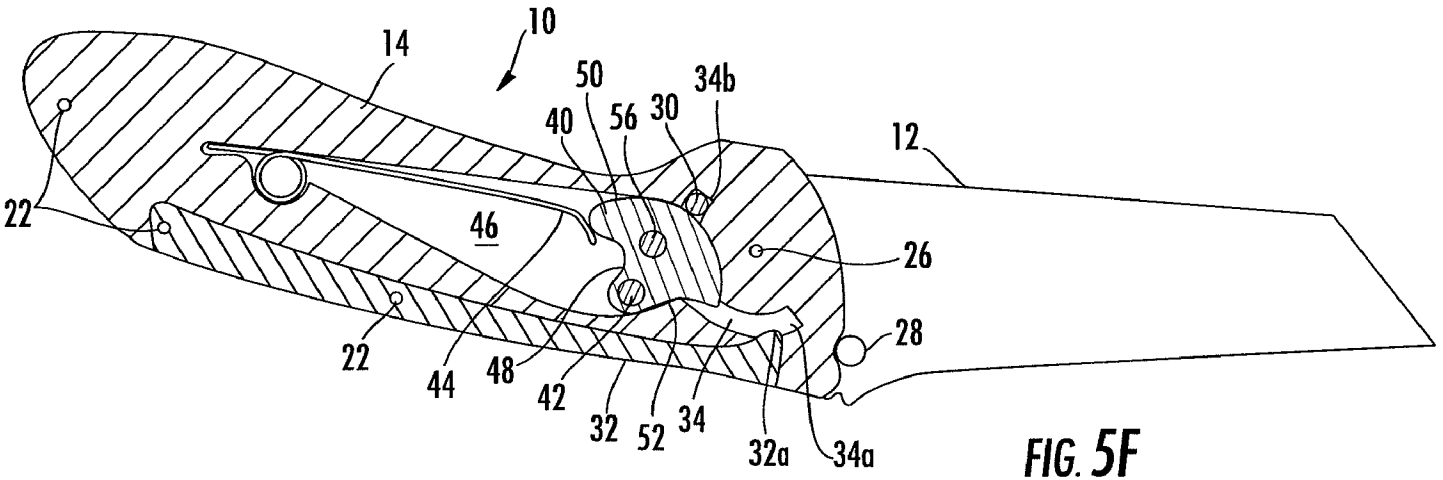
Figure 6:
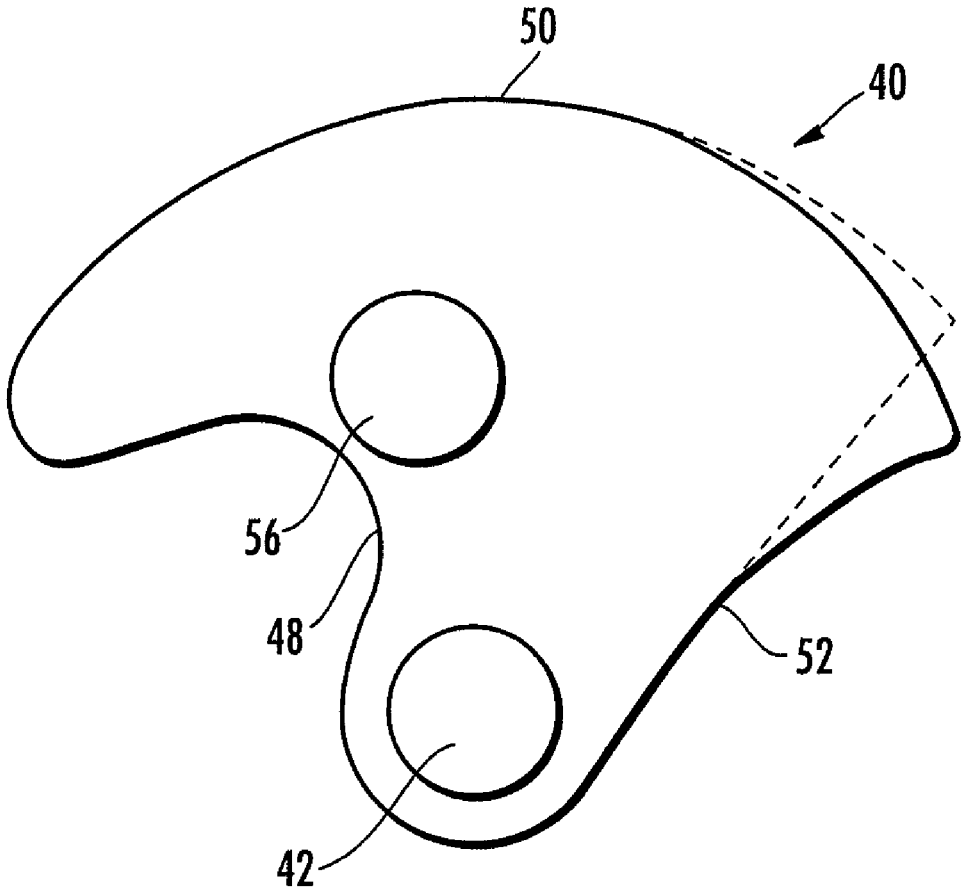

FIGS. 5*a*-5*f* are sequential cross-sectional views of the hand tool of FIGS. 1 and 2 as the implement is moved from a closed position as shown in FIG. 5*a* to an open position as shown in FIG. 5*f* according to one embodiment of the present invention; and FIG. 6 is a plan view of a cam member according to one embodiment of the present invention.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIGS. 1 and 2, a hand tool 10 recording the one embodiment is depicted in closed and open positions, respectively. As shown, the hand tool includes a rotateable implement that is configured to be moved between closed and open positions. For example, the rotateable implement may include a knife blade 12 as depicted in FIGS. 1 and 2 and as will be described below by way of example. However, the hand tool can include a wide variety of other rotateable implements, such as a saw, a serrated blade, a screwdriver, an awl, a bottle opener, a can opener, a file or the like.

Figure 3:
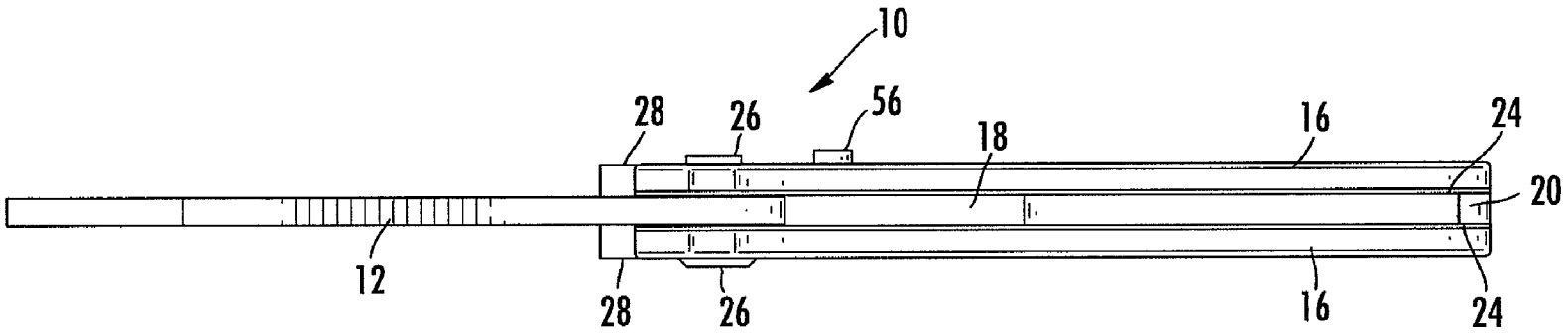
FIG. 3 is a side view of the hand tool of FIG. 2.

In addition to the rotateable implement 12, the hand tool 10 also includes a handle 14. In the illustrated embodiment as best shown in FIG. 3, the handle includes opposed handle portions 16 that are spaced from one another to define an internal cavity 18. The internal cavity may be sized such that the rotateable implement can be received within the internal cavity in the closed position. While the handle, including the opposed handle portions, may be formed as an integral component, the handle of the embodiment depicted in FIGS. 1-3 includes first and second handle portions that are spaced apart by one or more spacers 20 that are disposed between and/or extend inwardly from one or both of the handle portions. The handle of this embodiment also includes one or more fasteners 22 for securely connecting the first and second handle portions. In this regard, the fasteners can extend through the spacer(s) and the first and second handle portions to securely join the components of the handle. In one embodiment, the hand tool can also include liners 24 disposed upon the inwardly facing surfaces of the first and second handle portions in order to further define the internal cavity of the hand tool and to facilitate the movement of the rotateable implement into and out of the internal cavity. As shown, the liners generally have the same shape as the handle, but are typically much thinner. In one embodiment, the liners are formed of a material, such as steel or titanium, that provides substantial strength and structural rigidity for the hand tool, while the handles provide more aesthetic features. As such, the handles may be formed of any one or more of a wide variety of materials including aluminum, plastic, composite materials, e.g., carbon fiber materials, wood, steel, titanium, etc. Additionally, the hand tool need not include separate handles and liners and, instead, the handles and liners can be formed as a single integral element, if so desired.

The rotateable implement 12 of the hand tool 10 is connected to the handle 14 such that the rotateable implement is configured for rotation relative to the handle. In this regard, the rotateable implement can be connected to the handle by means of a fastener 26, such as a pin, extending from the handle through the rotateable implement, such as through a tang of the knife blade. The fastener thereby defines the pivot point about which the rotateable implement moves with respect to the handle. As such, the rotateable implement is configured to move between a closed position as shown in FIG. 1 in which at least portions of the rotateable implement are disposed within the internal cavity 18 defined by the handle to an open position as shown in FIGS. 2 and 3 in which the rotateable implement extends from the handle. With respect to a hand tool that includes a rotateable knife blade, the knife blade is typically folded at least partially into the handle in the closed position such that the cutting edge of the knife blade is disposed within the internal cavity with only a portion of the spine of the knife being exposed.

In order to facilitate manual movement of the rotateable implement 12 from the closed position to the open position, the implement may include a thumb stud 28 or other feature extending outwardly from one or both sides of that portion of the implement that remains exposed when the implement is in the closed position. As such, a user can push upon the thumb stud in order to provide the motive force for rotating the implement from the closed position to the open position. As shown in FIG. 2, the thumb stud or other outwardly extending feature can also serve as a stop for defining the fully open position of the implement. In this regard, the thumb stud or other outwardly extending feature can extend from the implement such that the thumb stud or other outwardly extending feature contacts the end of the handle 14 when the implement is in the fully open position, thereby preventing further rotation of the implement with respect to the handle.

In order to further facilitate rotation of the implement 12 relative to the handle 14, the hand tool 10 can include washers positioned between the handle and one or both sides of the tang of the rotateable implement in order to provide some space between the rotateable implement and the handle in order to facilitate rotational movement of the implement. These washers can be formed of a material, such as copper or phosphor bronze, having a lower coefficient of friction than the handle including any liners 24 disposed upon the interior surfaces of the handle, thereby reducing the frictional forces that would otherwise have to be overcome in order to move the implement from the closed position to the open position.

Figure 4:
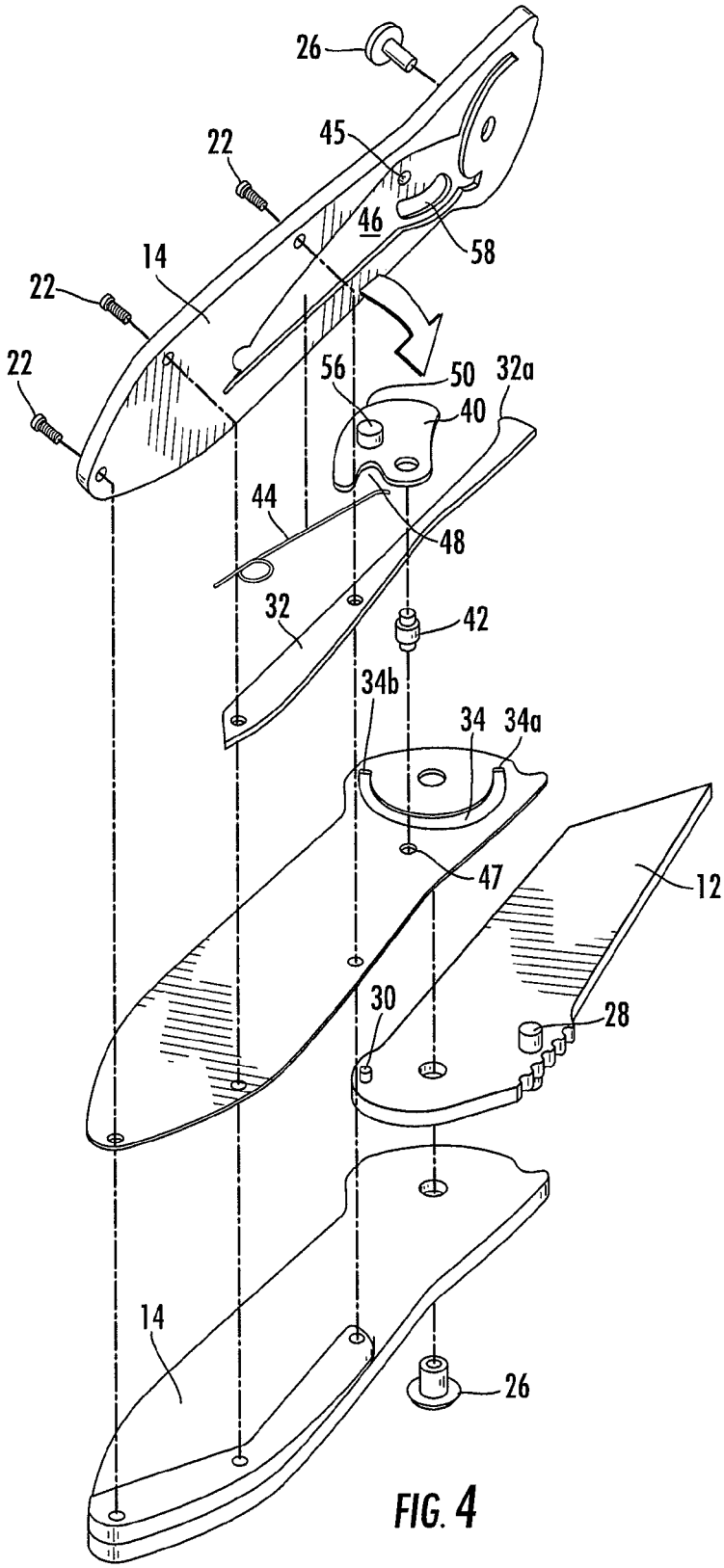
FIG. 4 is an exploded perspective view of a hand tool of FIG. 2.

As shown in FIGS. 4 and 5*a*, the implement 12 may be biased to remain in the closed position by means of the interaction of an engagement member 30 with a corresponding engagement spring 32. In this regard, the engagement member can be a post or other feature that is configured to move or rotate with the implement. In this regard, the engagement member may be carried by the implement, such as by extending outwardly from the implement. In order to permit movement of the engagement member with the implement, the handle 14 may define a track 34 in which the engagement member moves as the implement is moved between the open and closed positions. In the illustrated embodiment, for example, the engagement member is carried by the tang of the knife blade and is proximate the pivot point about which the knife blade rotates. As such, the track defined by the handle of this embodiment has an arcuate shape centered about the pivot point to facilitate movement of the engagement member therethrough. While the handle may define the tracks so as to extend completely through one of the handle portions 16, the handle may define the track only partially through one of the handle portions as depicted in the illustrated embodiment.

In the closed position, the engagement member 30 is generally disposed at a first end 34*a* of the track 34. In order to bias the implement 12 to remain in the closed position, the hand tool 10 can include an engagement spring 32 for contacting the engagement member and urging the engagement member into position at the first end of the track. As shown in FIG. 5*a*, the engagement spring can be a cantilever spring connected to the handle, such as by one or more fasteners 22. The engagement spring has a distal end 32*a* that contacts the engagement member, but that is not directly connected to the handle. As a result of its construction, the distal end of the engagement spring is biased into the position shown in FIG. 5*a* in which the distal end of the engagement spring extends into the track and secures the engagement member at the first end of the track.

However, in response to an opening force applied by a user, such as the motive force applied by a user to the thumb studs intended to move the implement 12 from the closed position into an intermediate position between the closed and open positions, the engagement member 30 moves through the track 34 in concert with the rotation of the implement, thereby causing the distal end 32*a* of the engagement spring 32 to flex such that the distal end of the engagement spring no longer extends into the track and the engagement member is permitted to move through the track. See, for example, FIG. 5*b*. In order to facilitate movement of the engagement member by the engagement spring, the distal end of the engagement spring that contacts the engagement member may be rounded. Once the engagement member has moved through the track beyond the engagement spring, the engagement spring will return to the position as shown in FIG. 5*c* in which the distal portion of the engagement spring is partially disposed within the track defined by the handle 14.

As the opening of the implement 12 continues, such as in response to a user-supplied motive force, the engagement member 30 moves through the track and comes into contact with a pivotable member 40 as shown in FIG. 5*c*. The pivotable member is pivotally connected to the handle, such as by means of a pivot pin 42 engaged at one end within an aperture 47 defined by the liner 24 and at the other within a recess defined by the handle portion 16. The pivotable member is therefore configured to pivot about the pivot point from a first position in which the pivotable member is disposed within the track defined by the handle to a second position in which the pivotable member is displaced from the track. As shown in FIG. 5*c*, the handle can also include a spring 44 for engaging the pivotable member and for biasing the pivotable member toward the first position. As illustrated, the pivotable member and the spring need not be in line with or in the same plane as the implement as in some conventional locking mechanisms, but are, instead, generally disposed within a cavity 46 defined by a handle portion 16 as shown in FIG. 4, or a liner 24 or some combination thereof.

As the implement 12 is moved from the closed position to the open position and the engagement member 30 correspondingly moves through the track 34 defined by the handle 14, the motive force applied to the implement in order to open the implement must be sufficient to overcome the bias force applied by the spring 44 such that further opening of the implement causes the engagement member to continue to move through the track and to accordingly cause the pivotable member 40 to rotate about the pivot point in order to eventually be displaced from the track and to permit movement of the engagement member therepast, as shown in FIGS. 5*d* and 5*e*. As will be noted particularly in FIG. 5*d*, the pivotable member may define a recess 48 to accomodate a distal end of the spring as the pivotable member pivots about the pivot pin 42.

The track 34 defined by the handle 14 may be sized to have opposed first and second ends 34*a*, 34*b* that extend beyond the pivotable member 40. Since the engagement member 30 rotates with the implement 12, the track is generally sized to extend about the same angle through which the implement is intended to rotate. In the illustrated embodiment, for example, the implement is configured to rotate about 180° between the closed and open positions and the track also extends about 180° about the pivot point.

As the implement 12 is being opened, therefore, the engagement member 30 will move within the track 34 beyond the pivotable member 40. Typically, the hand tool 10 is designed such that the implement reaches the fully open position just as the engagement member moves past or beyond the pivotable member. Due to the bias force provided by the spring 44, the pivotable member is returned to the first position once the engagement member has moved beyond the pivotable member as shown in FIG. 5*f*. Since the fully open position of the implement is generally defined such that the engagement member has moved beyond, but remains adjacent to the pivotable member, the movement of the pivotable member to the first position generally brings the pivotable member into contact with the engagement member, thereby blocking any return movement of the engagement member through the track defined by the handle so as to lock the implement in the open position. In other words, the return of the pivotable member to the first position effectively secures the engagement member at the second end 34*b* of the track and prevents any return movement of the engagement member through the track in a direction toward the first end 34*a* of the track.

In order to not only lock the implement 12 in the open position, but to secure the implement in the fully open position, the pivotable member 40 of one embodiment is embodied as a cam member which is generally defined to have a curved surface 50, as shown in more detail in FIG. 6. The curved surface of the cam member is generally spaced from the pivot point of the cam member by a distance that increases the direction away from the first edge 52 of the cam member. In other words, the curved surface of the cam member is spaced from the pivot point by a distance that increases from the first edges of the cam member to a portion of the cam member spaced apart from the first edge of the cam member. In this regard, the first edge of the cam member is that edge that faces the first end of the track and is initially contacted by the engagement member 30 as the implement is moved from the closed position to the open position. With respect to FIG. 6, dashed lines indicate the size and shape of the cam member if the curved surface of the cam member had a uniform radius. As shown, however, the curved surface proximate the first edge recedes so as to define a smaller radius relative to the pivot point.

By defining the curved surface 50 in this manner, the return of the cam member of this embodiment to the first position effectively urges the engagement member 30 further along the track 34 toward the second end 34*b* as the cam member moves toward the first position and the engagement member rides along the curved surface in a direction away from the first edge 52 of the cam member. In other words, the cam member wedges the engagement member toward the second end of the track, thereby urging the implement 12 into a more fully open position. While this design is generally useful to urge the implement into the fully open position, the camming action provided by the curved surface of the cam member is particularly advantageous in accommodating tolerances associated with the various components of the hand tool 10. In this regard, each component of the hand tool is generally fabricated to within a predefined tolerance. In some instances, it is therefore possible for each component to be within the desired tolerance, but for the implement not to be locked in the fully open position even though the engagement member has moved through the track beyond the cam member. By constructing the curved surface of the cam member in the manner described above, the cam member of this embodiment provides effective compensation for such tolerance issues and urges the engagement member in such a manner that the implement is secured in the fully open position, notwithstanding the tolerances of the various components of the hand tool. Indeed, the camming action provided by the cam member may even permit the tolerances of some components to be loosened in some embodiments, thereby simplifying the fabrication process.

As a result of the biasing of the pivotable member 40 into the first position, the engagement member 30 is retained proximate the second end 34*b* of the track 34 and is prevented from returning through the track to the first end 34*a* of the track, thereby effectively locking the implement 12 in the open position as shown in FIG. 5*f*. In order to unlock the implement, the hand tool 10 can include an actuation member 56 operably connected to the pivotable member, such as by being integral with and extending outwardly therefrom. In this regard, the handle 14 can also define a slot 58 through which the actuation member extends. In order to release the implement and to permit the implement to be moved from the open position of FIG. 2 to the closed position of FIG. 1, the actuation member can be manually moved through the slot in such a manner that the pivotable member is moved from the first position which effectively blocks the blade from traversing the track to the second position in which the engagement member is again permitted to move through the track. Since the actuation member is operably connected and moves with the pivotable member, the slot defined by the handle is generally an arcuate slot about the pivot point of the pivotable member. Once the implement has been sufficiently folded from the open position toward the closed position such that the engagement member has again moved past the pivotable member, such as shown in FIG. 5*e*, the actuation member can be released such that the pivotable member is again returned by the spring 44 to its first position.

As the implement 12 nears the closed position, the engagement member 30 will come into contact with the distal end 32*a* of the engagement spring 32. As such, somewhat additional manual force is generally required to be applied in order to deflect the engagement spring and to permit the engagement member to move therepast. Once the engagement member has moved past the engagement spring, such as into a position proximate the first end 34*a* of the track 34, the engagement spring returns to its unbiased position as shown in FIG. 5*a* in which at least a portion of the distal end of the engagement spring extends into the track defined by the handle, thereby biasing the engagement member proximate the first end of the track and, in turn, biasing the implement to remain in the closed position. The foregoing process of opening and closing the implement as depicted in FIGS. 5*a*-5*f* can then be repeated as desired in order to appropriately position the implement.

While a hand tool 10 having a single implement 12, e.g., a knife blade, is depicted and has been described, the hand tool can include additional implements if desired. In this regard, the additional implements may be fixed implements that fixably extend from the handle 14 and/or the additional implements may be additional rotateable implements that fold into the handle, either on the same side as the implement as described above or from the opposite side of the handle. In embodiments that include additional rotateable implements, the additional rotateable implements may also be pivoted about the same pivot point as the rotateable implement described above or the additional rotateable implement may be independently pivoted about a pivot point defined elsewhere along the handle, such as by a medial portion of the handle or by the opposite end of the handle. Moreover, any additional rotateable implements may, but need not necessarily, include the locking mechanism described above in conjunction with FIGS. 5*a*-5*f*.

Accordingly, the folding tool 10 and associated handle 14 of embodiments of the present invention permit an implement 12 to be moved between closed and open positions, while securely locking the implement in the open position. In this regard, the folding tool and associated handle include a pivotable member 40, such as a cam member having a curved surface 50 for urging the implement fully into the open position, thereby providing a secure and reliable locking mechanism. Additionally, the locking mechanism including the engagement member 30, the engagement spring 32, the track 34, the pivotable member and the spring 44 can be disposed within one of handle portions 16. As such, the locking mechanism need not be disposed within the internal cavity 18 defined between the handle portions, such as inline with or in the same plane as the rotatable implement as may be required by some conventional locking mechanisms, thereby leaving the internal cavity uncluttered with additional space for other implements or the like.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A folding tool comprising:

a handle defining a track;

an implement pivotably connected to the handle for moving between a closed position and an open position; and a lock for retaining the implement in the open position, the lock comprising:

a pivotable member configured to pivot relative to the handle between first and second positions; and an engagement member disposed within the track and configured for movement with the implement through the track, the engagement member also configured to engage the pivotable member upon movement of the implement from the closed position to the open position in order to move the pivotable member from the first position toward the second position;

wherein the pivotable member is configured to return to the first position once the implement is in the open position in order to secure the implement in the open position, and wherein the pivotable member comprises a cam member configured to pivot about a pivot point, wherein the cam member comprises a curved surface spaced from the pivot point by a distance that increases from a first edge of the cam member to a portion of the cam member spaced from the first edge of the cam member, wherein the engagement member is configured to engage the first edge and the curved surface during movement of the implement from the closed position to the open position, wherein in the first position the pivotable member at least partially overlies the track, and wherein in the second position the pivotable member moves away and is spaced apart from the track so as to no longer overlie the track.

2. A folding tool according to claim 1, wherein opposite ends of the track extend beyond the pivotable member such that movement of the engagement member with the implement between the open and closed positions causes the pivotable member to be displaced from the track into the second position while the implement is in an intermediate position and to permit the pivotable member to return to the first position while the implement is in both the open and closed positions.

3. A folding tool according to claim 1 further comprising a spring for biasing the pivotable member toward the first position.

4. A folding tool according to claim 1 further comprising an actuation member operably connected to the pivotable member and configured to permit manual movement of the pivotable member relative to the handle.

5. A folding tool according to claim 1 further comprising an engagement spring for engaging the engagement member once the implement is in the closed position in order to bias the implement to remain in the closed position.

* * * * *